United States Patent [19]

Frost et al.

[11] 3,986,234

[45] Oct. 19, 1976

[54] RELEASABLE FASTENER

[75] Inventors: Richard H. Frost, Littleton; Ronald L. Criley, Lake City, both of Colo.

[73] Assignee: Frost Engineering Development Corporation, Englewood, Colo.

[22] Filed: Oct. 20, 1975

[21] Appl. No.: 623,622

[52] U.S. Cl. ..... 24/230 AT; 24/230 AV

[51] Int. Cl.[2] ..... A44B 11/25

[58] Field of Search .... 24/230 A, 230 AT, 230 AV, 24/230 LP, 230 AK, 230 AN, 205.17

[56] References Cited

UNITED STATES PATENTS

| | | | |
|---|---|---|---|
| 2,459,223 | 1/1949 | Henderson | 24/230 AV |
| 2,970,796 | 2/1961 | Ross | 24/205.17 |
| 3,330,014 | 7/1967 | Gaylord | 24/230 A |
| 3,404,439 | 10/1968 | Jones et al. | 24/230 AT |

*Primary Examiner*—Paul R. Gilliam
*Assistant Examiner*—Kenneth J. Dorner
*Attorney, Agent, or Firm*—Burton, Crandell & Polumbus

[57] ABSTRACT

A releasable fastener for securing together two straps, includes a link adapted for attachment to one such strap and shaped as a generally plate-like strike having a pair of spaced-apart locking lugs on opposite edges defining locking notches. A guide channel is provided in one surface of the strike intermediate the lugs for guiding the link into engagement with a buckle adapted to be secured to the other such strap. The buckle is formed by a body having spaced-apart upper and lower plates defining a slot for receiving the strike. A pair of spaced-apart lock-pins extend through the upper plate and said slot into the lower plate, with the portion of said lock-pins exposed between the said plates being notched to define lands for engaging into the locking notches on the strike. The lock-pins are rotated to position the lands in the notches by a slide mounted on the upper plate. The slide includes a flanged slide post slidably positioned in an elongated slot defined in the upper plate with the flange engaging the under-surface of the upper plate to hold the slide thereon. A spring on the post biases the slide to its forwardmost position. Bifurcated levers secured to the upper ends of the lock-pins, with the forked ends thereof engaging said post, serve to rotate the lock-pins in response to sliding movements of the slide. A latch is pivotally mounted on the buckle body for rotating movement in response to a force thereon acting in a direction opposite to the force required to move the slide to the strike unlocking position. Until the latch is thus rotated, interfering surfaces on the slide and latch prevent inadvertent movement of the slide.

10 Claims, 17 Drawing Figures

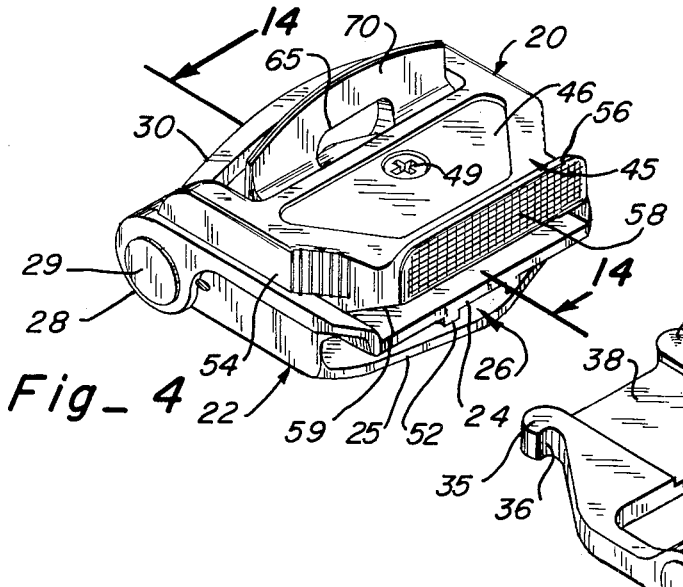
Fig_4
Fig_5
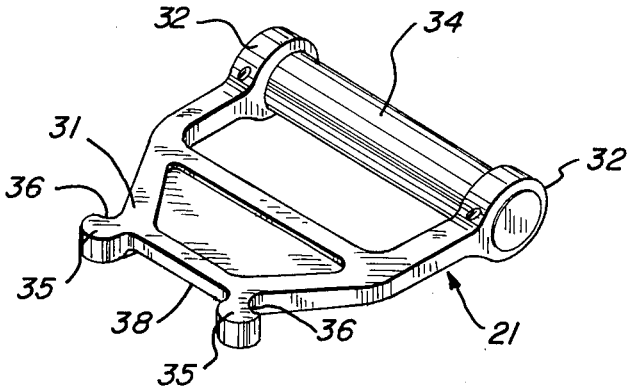
Fig_6

RELEASABLE FASTENER

The invention described herein was made in the course of or under a contract or subcontract thereunder, with the U.S. Department of Defense.

BACKGROUND OF THE INVENTION

1. Field of the Invention

The present invention relates to releasable fasteners for securing straps, webbing or belts together, and more particularly, to release and link assemblies for use in releasably securing the straps of a parachute canopy to a pilot's harness, releasably joining each pair of straps that constitute the chest and leg straps of the harness, and releasably connecting the two portions of a lap belt.

2. Description of the Prior Art

Releasable fasteners for securing belts, straps, webbing and the like together, and particularly for use in securing the straps of a parachute canopy to a pilot's harness, are well known in the art. See, for example, U.S. Pat. No. 3,404,439, issued Oct. 8, 1968 to H. W. Jones et al. for "Fastener For Use On Parachute Harnesses"; U.S. Pat. No. 3,330,014, issued June 11, 1967 to J. A. Gaylord for "Releasable Strap Connector"; and U.S. Pat. No. 3,183,568 issued May 18, 1965 to J. A. Gaylord for "Canopy Release."

Objects Of The Invention

It is the principal object of the present invention to provide an improved releasable fastener finding particular but not necessarily exclusive utility as a release and link assembly for securing the straps of a parachute canopy to a pilot's harness, for joining each pair of its leg and chest straps, and for coupling seat safety belt halves.

Another object of the present invention is to provide a releasable fastener which embodies new and improved safety characteristics.

Still another object of the present invention is to provide an improved releasable fastener in which both the release operation and the latching operation are positively effected.

A further object of the present invention is to provide release and link assemblies of the foregoing character which are not subject to inadvertent release under centrifugal, acceleration or inertial forces, nor by movement of the connected webbing or contact by other extraneous objects.

A more detailed object of the invention is to provide a releasable fastener of the foregoing character which can be actuated when the user is wearing gloves, or with an injured hand, or can even be actuated between the user's palms, and yet without sacrificing, and even improving, the safety characteristics of the fastener.

More specifically, it is an object of the present invention to provide a releasable fastener which cannot be accidentally actuated and yet which can be readily intentionally operated even under highly adverse circumstances.

Summary Of The Invention

In accordance with the foregoing objects and as shown in the accompanying drawings, the present invention comprises a buckle and link adapted to be releasably engaged for purposes of securing two straps together. The buckle is formed by a body including spaced-apart upper and lower plates defining a slot into which the link is inserted. The link is a generally flat, plate-like member having a male member or strike adapted to be inserted into the buckle slot. The strike defines on opposite edges a pair of spaced-apart lugs each of which in turn defines a locking notch. A guide channel is defined on one surface of the strike for orienting and guiding the link into the buckle slot. The strike is secured in the buckle by a pair of lock-pins having lands thereon adapted to engage in the notches behind each strike lug. The lock-pins are rotated by engagement of bifurcated arms attached thereto with a slide member mounted on the upper plate. The slide itself is biased to the forward locking position by an appropriate spring means. For locking the slide against unintentional movement, a latch is provided on the buckle assembly. The latch and slide embody interfering surfaces which engage to prevent inadvertent movement of the slide. By squeezing the latch and slide together, the interference is temporarily eliminated allowing the slide to move towards the latch. The rearward movement of the slide rotates the lock-pins to the unlock position enabling the link to be inserted into or withdrawn from the buckle. Upon releasing the slide and latch, the former returns to its forward position thereby rotating the lock-pins to their locking orientation, while the latch swings upwardly to dispose the locking edges into interference with the juxtaposed end surfaces of the slide, and thereby restore the interference between the surfaces of the latch and slide.

DESCRIPTION OF THE DRAWINGS

FIG. 4 is a top perspective view of the buckle portion in release position.

FIG. 5 is a top perspective view of a link as utilized in the present invention.

FIG. 6 is a bottom view of the link shown in FIG. 5.

Description Of The Preferred Embodiment

Figure 1:
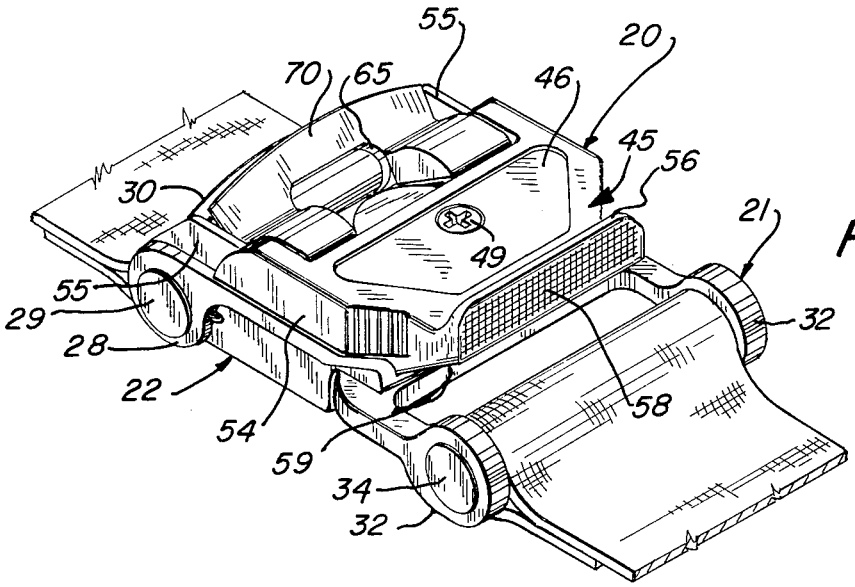
FIG. 1 is a top perspective view of a releasable fastener embodying the present invention including a buckle and link engaged therewith.
Figure 2:
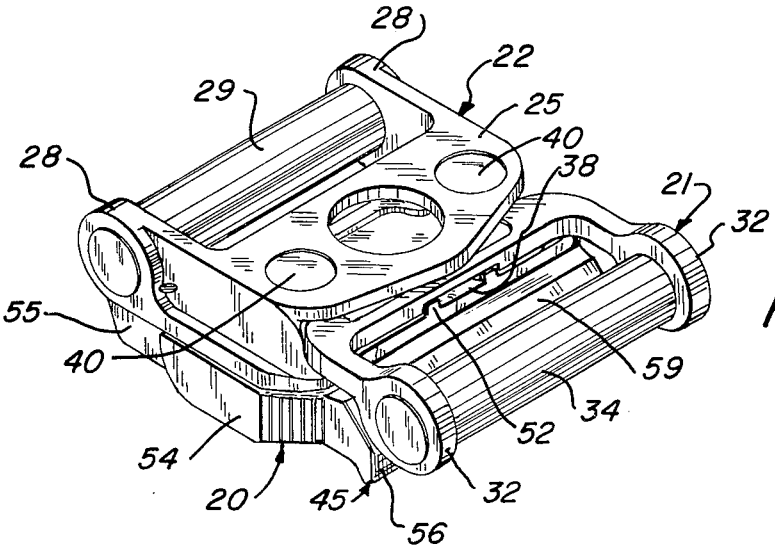
FIG. 2 is a bottom perspective view thereof.
Figure 3:
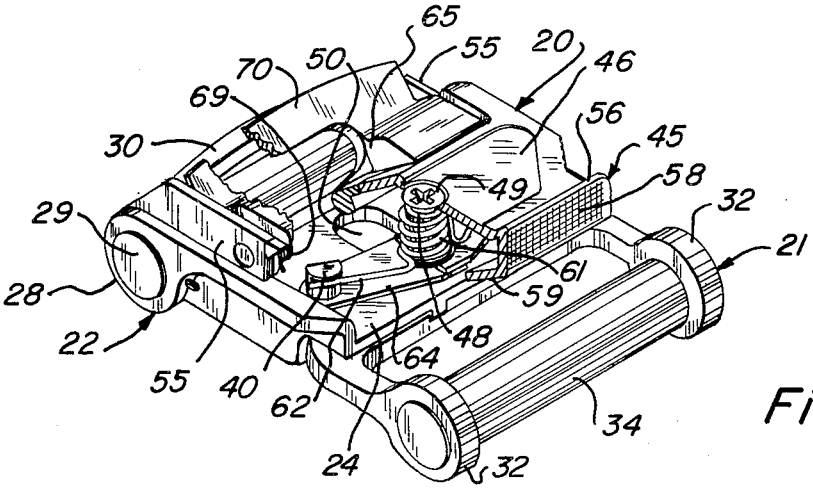
FIG. 3 is a top perspective view thereof with parts cut away to reveal interior details.
Figure 7:
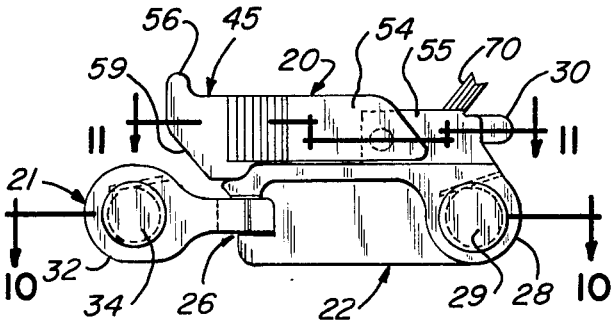
FIG. 7 is a side elevation view of the fastener shown in FIG. 1.
Figure 8:
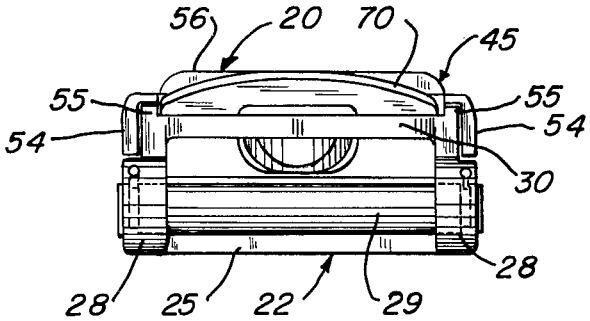
FIG. 8 is a rear elevation view thereof.
Figure 9:
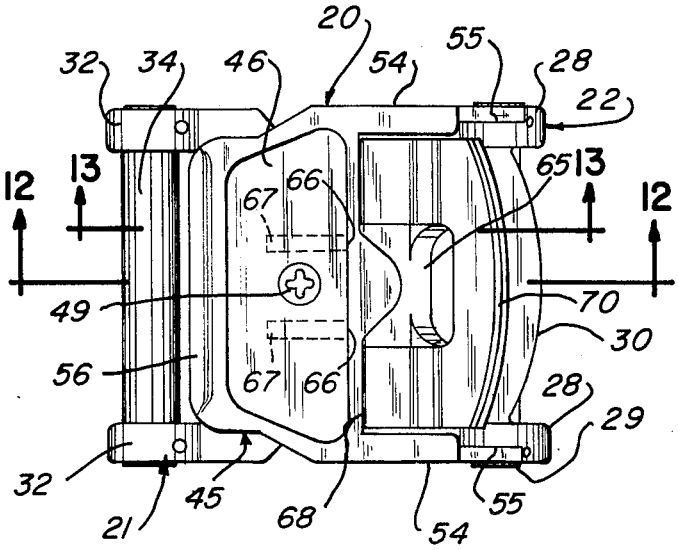
FIG. 9 is a top plan view thereof.
Figure 10:
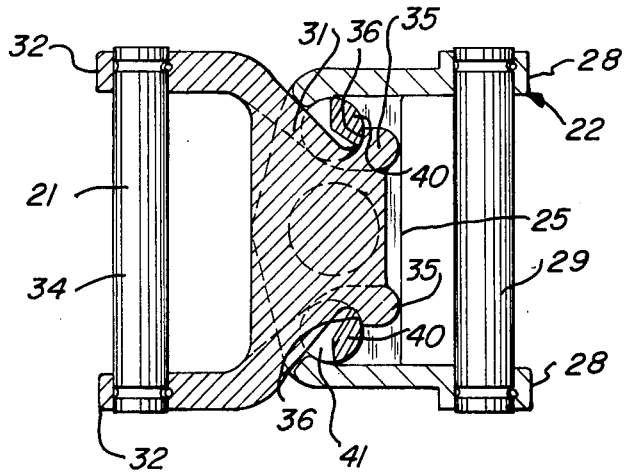
FIG. 10 is a section view taken substantially in the plane of line 10—10 on FIG. 7.
Figure 11:
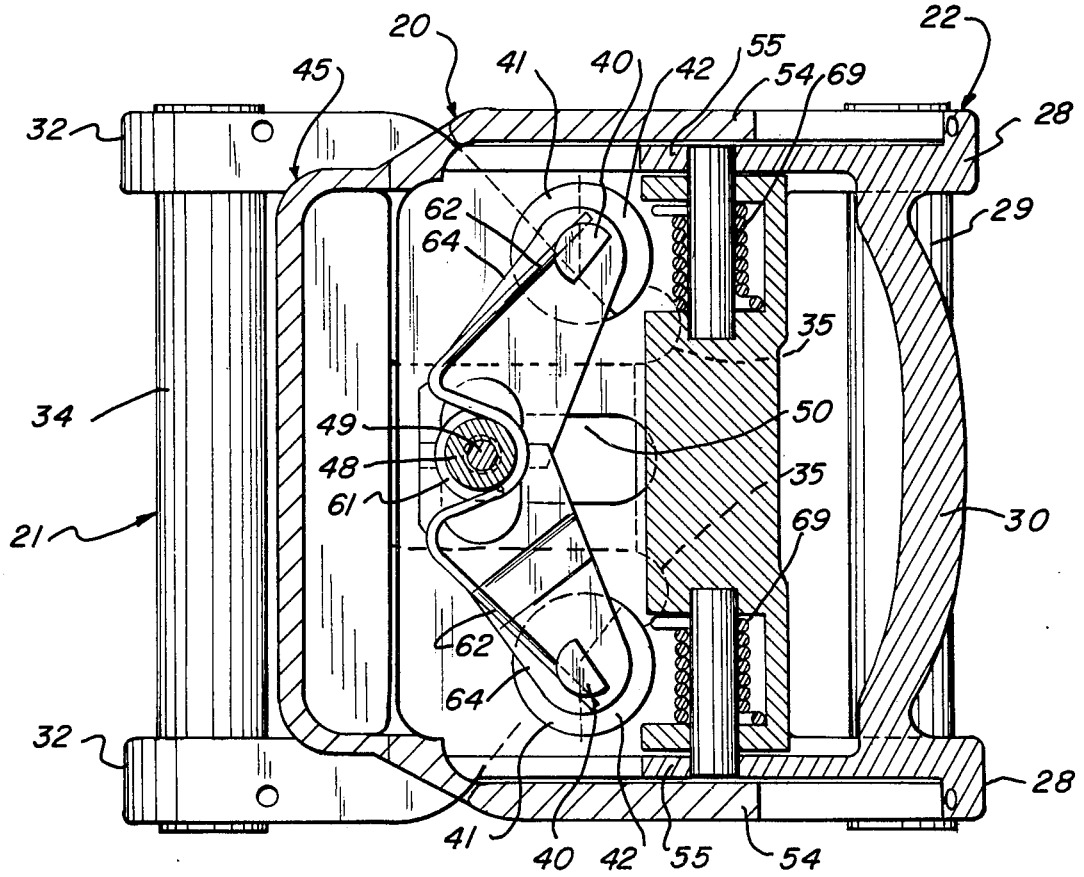
FIG. 11 is an enlarged section view taken substantially in the plane of line 11—11 on FIG. 7.
Figure 12:
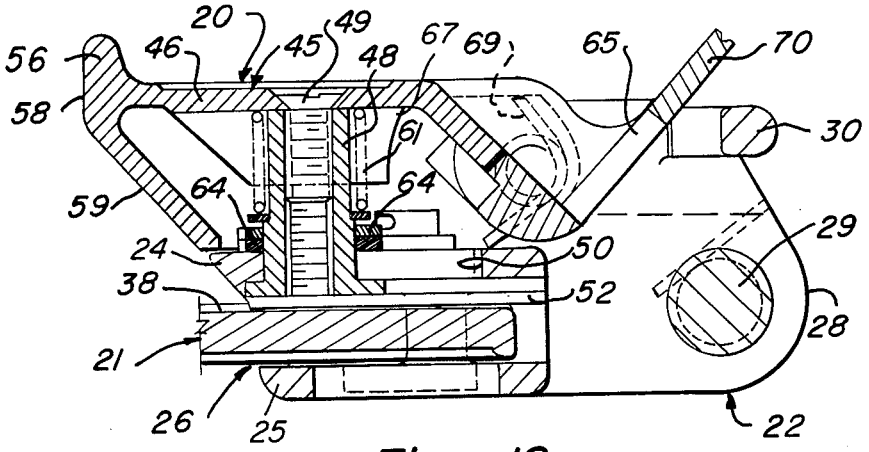
FIG. 12 is an enlarged section view taken substantially in the plane of line 12—12 on FIG. 9.
Figure 14:
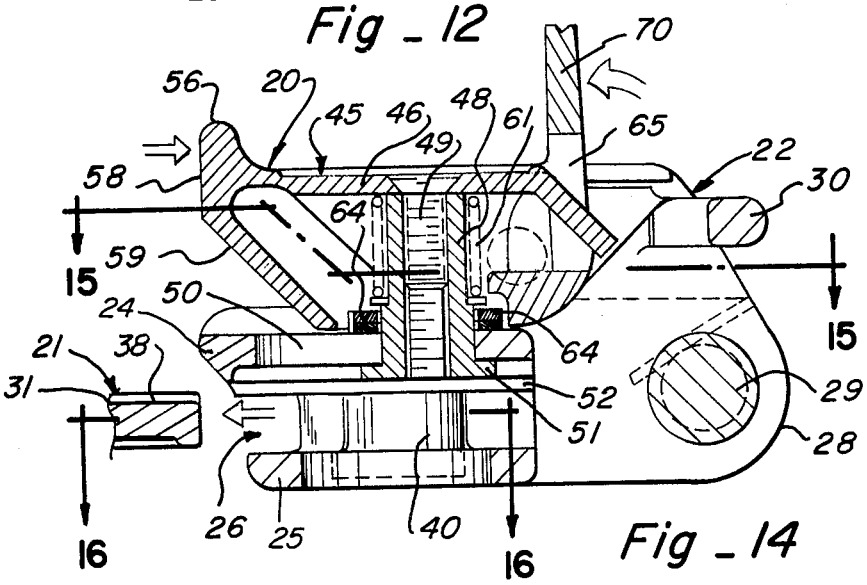
FIG. 14 is an enlarged section view taken substantially in the plane of line 14—14 on FIG. 4, and showing a portion of a link disengaged from the buckle.
Figure 13:
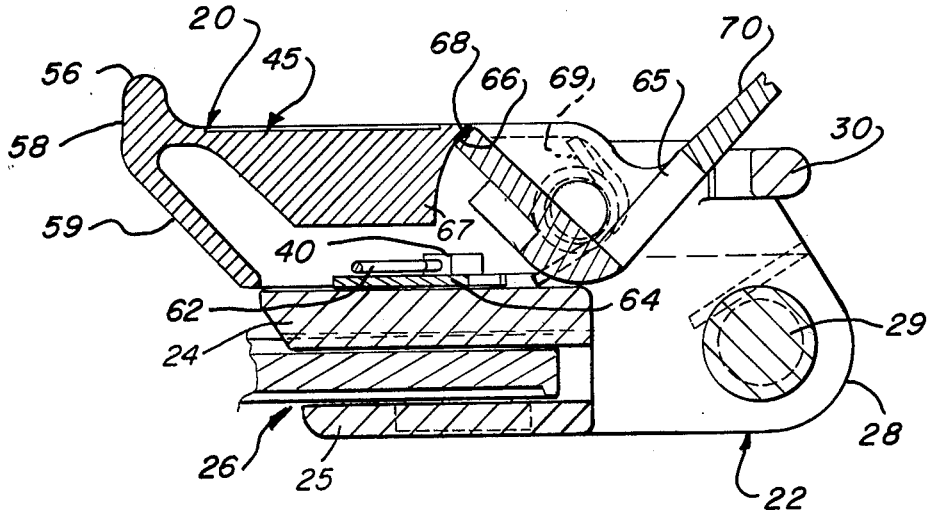
FIG. 13 is an enlarged section view taken substantially in the plane of line 13—13 on FIG. 9.
Figure 15:
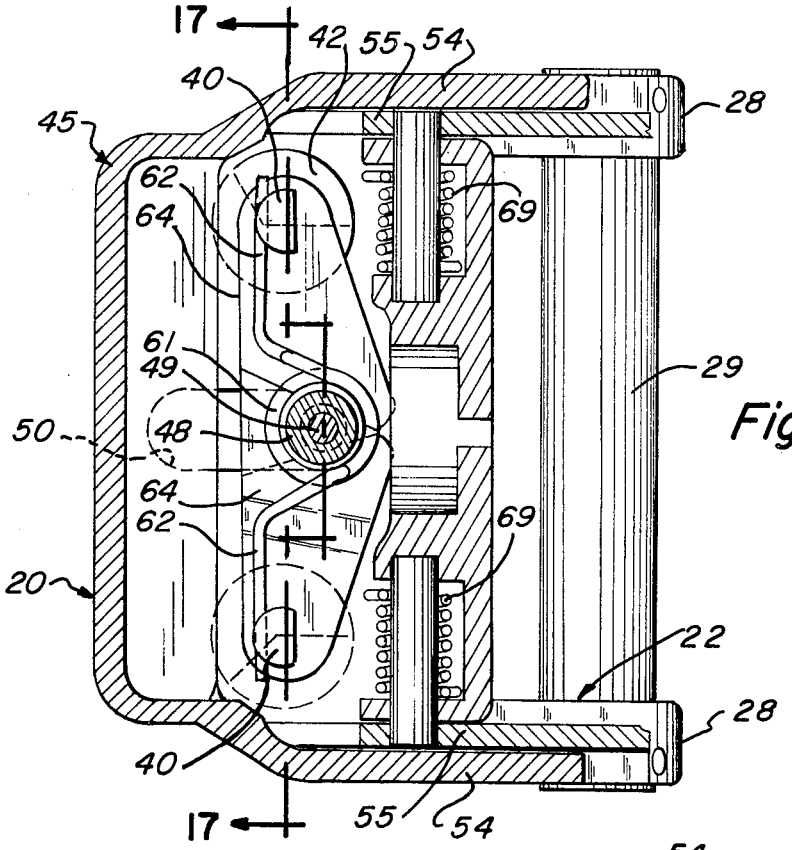
FIG. 15 is a section view taken substantially in the plane of line 15—15 on FIG. 14.
Figure 16:
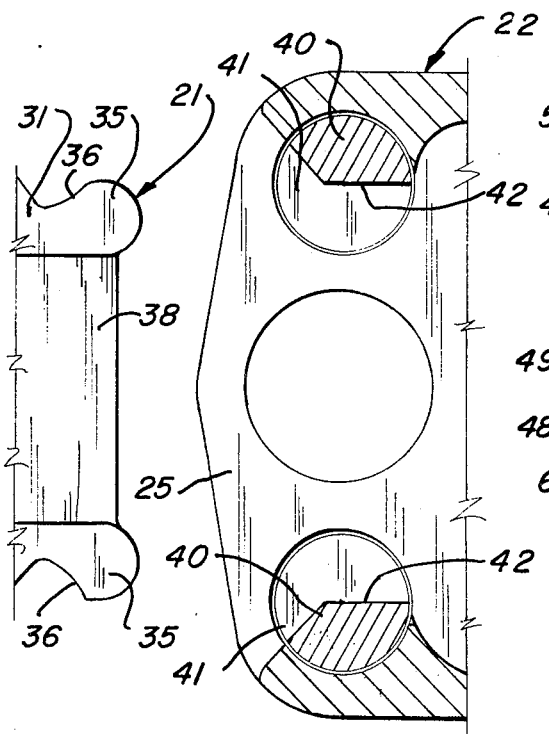
FIG. 16 is a section view taken substantially in the plane of line 16—16 on FIG. 14.
Figure 17:
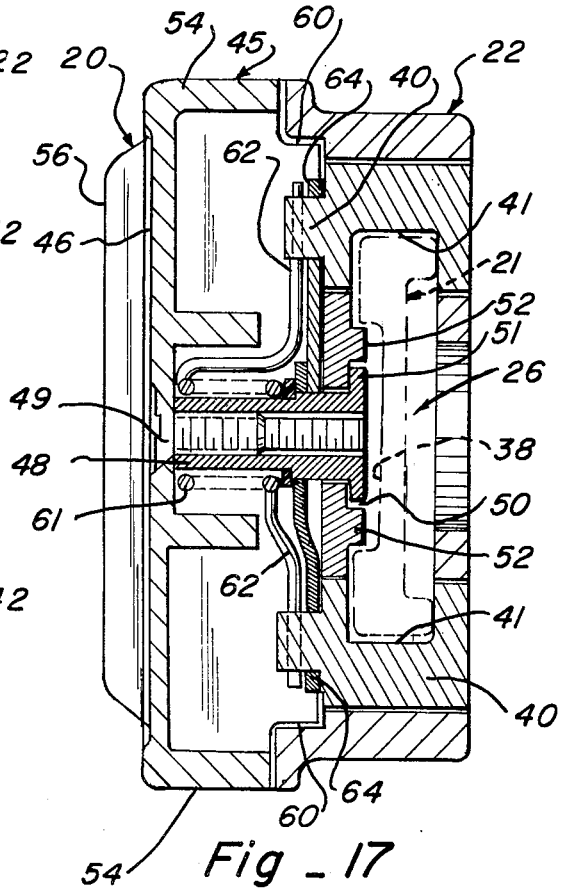
FIG. 17 is a section view taken substantially in the plane of line 17—17 on FIG. 15.

The releasable fastener embodying the present invention as shown in the drawings, comprises a latching member or buckle 20 and a link or strike 21 engageable therewith. The link is adapted to be secured at one end of a strap, such as the strap of a parachute canopy (not shown), while the buckle is adapted to be secured to another strap, such as a strap forming a part of a pilot or aircraft crewman's body harness (not shown). The link 21 is inserted into and releasably held in the buckle 20 to couple the straps together, for example, to couple the parachute canopy to the body harness. When it is desired to release the parachute canopy from the harness, the pilot or crewman actuates the buckle to release the link. Unless the buckle is positively actuated, however, the link is tightly secured therein and is held securely even under highly adverse centrifugal, inertia or acceleration forces and accidental impacts by extraneous objects.

The buckle is constructed to receive and releasably latch the link 21. To this end, the buckle is formed by a body 22 including spaced-apart upper and lower plates 24, 25 respectively, defining a slot 26 into which the link 21 is inserted. For engaging one end of a strap or web (not shown) the body 22 is provided at the end thereof opposite from the plates 24, 25 with apertured spaced-apart ears 28 supporting a web engaging roller 29 or other suitable web engaging means. For preventing the web thus engaged from interfering with the latching mechanism of the buckle, a latch protector bar 30 extends between the ears in spaced juxtaposition above the web roller 29. To avoid interference with or hindering operation of the latch mechanism, the protector bar 30 is desirably curved outwardly as shown in the drawings.

The link 21 comprises a generally flat plate-like member having a male end or strike 31 adapted to be inserted into the buckle slot 26. For engaging a second strap or web (not shown), the link includes a pair of spaced ears 32 supporting a web engaging roller 34 or other suitable web engaging means, at the end of the link opposite from the strike 31. The strike 31 defines a pair of spaced-apart strike lugs 35 each of which defines a locking notch 36 on the strike. A guide channel 38 is defined on one surface of the strike 31 between the lugs 35 and notches 36 for use in orienting and guiding the link into the buckle slot 26.

In order to securely latch the link 21 to the buckle 20 when the strike 31 is inserted into the buckle slot 26, the buckle is provided with a pair of spaced-apart rotatable lock-pins 40 extending between the plates 24, 25 and adapted to be releasably engaged in the notches 36 defined behind each strike lug 35. For this purpose, the lock-pins are recessed along the portion of their length extending through the slot 26 to define a slot or notch 41 and a locking land 42. The slot or notch 41 is of sufficient depth to allow the lugs 35 to slide past the land 42 when the lock-pins are rotated to expose the notches, while the land 42 is of sufficient width to rotate into the strike notch 36 behind the lug 35 and thereby lock the link into the buckle. By rotating the lock-pins, they are positioned either to allow relative movement between the link and buckle, or to lock the link positively in the buckle.

For positively rotating the lock-pins 40 from their locking position with the land portion 42 thereof in position for engagement behind the strike lugs 35, which position also precludes insertion of the strike into the slot, to their unlocking position wherein the notches 41 are positioned to permit insertion or withdrawal of the strike 31, a latching slide 45 is provided above and in sliding juxtaposition with the upper plate 24. The slide embodies a top plate or web 46 to which is secured a depending flanged slide post 48 fastened to the slide plate 46 by a screw 49 or other fastener. The slide post 48 extends through an elongated slot 50 in the upper plate 24 of the buckle with the flange 51 thereof slidably engaging the under surface of the upper buckle plate 24. Appropriate guide means, such as a pair of spaced depending guide lugs 52, are provided on the under surface of the upper plate 24 for receiving and guiding the guide channel 38 in the upper surface of the link strike 31. Alternatively, the flange 51 on the slide post 48 may be of sufficient diameter to serve as the strike guide. The upper surface of the slide plate may be recessed to receive a label or other plate which hides the screw 49.

The slide 45 is further guided on the buckle body 22 by means of side flanges or walls 54 which depend from the slide plate 46 on opposite sides of upstanding spaced guide flanges 55 integral with the buckle body ears 28. To further guide the slide, the walls 54 may be provided with outturned ribs or feet (not shown) which are slidingly received in slots (not shown) in the flanges 55.

To enable a user to grip and manipulate the slide, the front wall thereof is provided with an upstanding lip 56 which may be knurled on its outside forward surface 58. For further supporting of the slide 45, the slide plate 46 is further provided with a front wall 59 which slopes downwardly and inwardly towards the upper buckle plate 24 with the lower vertical edge corners 60 thereof slidingly engaged between upturned side walls or rims on the upper surface of the plate 24. Additional knurled gripping surfaces may be provided on the depending side walls 54 of the slide 45.

The slide is normally biased to its forwardmost position by a biasing spring 61, such as a coil spring, which surrounds the slide post 48 with the spring legs 62 each engaged in front of an upstanding end of the adjacent lock-pin 40. Thus, as the slide and slide post are moved rearwardly, the spring 61 tends to be coiled thereby creating a forward bias on the slide which urges the slide to its forwardmost position when released. Alternatively, of course, the spring legs 62 can engage in front of any appropriate abutment on the upper surface of the plate 24 in order to provide the desired forward bias on the slide 45.

For rotating the lock-pins 40 from the lock position when the slide is in its forwardmost orientation to the unlock position when the slide 45 is in its rearwardmost position, a bifurcated lever arm 64 is secured to the upper end of each lock-pin 40. The forked end of each lever arm 64 engages the slide post 48 so that, as the slide 45 and slide post 48 move back and forth, the slide post 48 swings the lever arms 65 which in turn rotate the lock-pins 40. The lock-pins 40, lever arms 64, slide 45 and slide post 48 are so oriented that when the slide is in its forwardmost position, the lock-pins 40 are positioned with the lands 42 in locking position to prevent ingress or egress of the link strike 31. When the slide is moved to its rearmost position against the biasing force of the spring 61, the lock-pins 40 are rotated to position the notches 41 to open the buckle and permit ingress or egress of the link strike 31. When the link has been inserted into the slot 26, and the slide released, the spring 61 urges the slide forwardly thereby rotating the lock-pins 40 to lock the link 21 securely and positively into the buckle 20. If the spring 61 should be broken or inoperative, the user can manually pull the slide forward to lock the strike in place.

In order to releasably lock the slide in its forwardmost position, and thereby prevent accidental or unintentional actuation thereof with the concomitant possibility of inadvertent release of the link 21 from the buckle 20, the buckle is provided with a slide latch member 65 which releasably engages the rear edge or surface 66 of depending spaced parallel flanges or buttresses 67 on the underside of the slide plate 46 to prevent rearward sliding movement of the slide 45. The latch 65 is rotatably or pivotally mounted by hinge pins between the upstanding guide flanges 55 adjacent the rearward ends of the side flanges 54 of the slide plate 46. For latching the slide 45 against movement, the forward edge 68 of the latch 65 is positioned to engage the rearward surfaces 66 of the buttresses 67 on the slide and thereby interfere with the slide movement and prevent unintentional rearward movement of the slide 45. The latch is biased to raise the interference edges 68 into slide engaging interfering position by coil springs 69. For rotating the latch against the force of the biasing spring 69 to lower the latch edge 68 towards the upper plate 24 thereby to clear the interfering edges, the latch is provided with an upwardly inclined rearwardly extending handle or grip 70 engageable by the user's finger-tips, thumb or palm. By exerting a force on the latch grip 70, the latch is rotated to clear the interfering surfaces 66, 68. It should be noted that the direction of the force exerted on the grip 70 is in direct opposition to the direction of force exerted on the slide 45 to move the slide rearwardly to its strike unlatching position.

It will be appreciated that operation of the buckle latch mechanism may be accomplished with one hand. The user may engage the latch grip 70 with his fingers while simultaneously engaging the slide lip 56 with his thumb or palm, or vice versa. By squeezing the slide 45 and latch 65 together, the latch grip 70 is swung forwardly toward the slide 45 thereby releasing the interfering surfaces 68, 66 and allowing the user to press the slide 45 rearwardly. The rearward movement of the slide rotates the lock-pins 40 to the unlocked position thereby enabling the link 21 to be inserted into or withdrawn from the buckle 20. When the desired link movement has been accomplished, the user releases the buckle and the slide spring 61 moves the slide 45 forwardly while the latch spring 69 swings the latch 65 rearwardly. The interfering surfaces 66, 68 are thus juxtaposed and the buckle is in the latched position. Because the slide and latch must be moved in relatively opposite directions, it becomes impossible for centrifugal, inertial or acceleration forces to actuate the buckle to release the link inadvertently no matter how severe the forces become. Further, by adjusting the center of gravity of, the latch 65, inadvertent actuation or release thereof by acceleration forces is precluded.

The releasable fastener embodying the present invention as herein described possesses numerous advantages and desirable features. The buckle is of relatively light weight which reduces the chances or severity of injury to the crewman. The buckle and link possess no sharp corners or edges which might cut or cause the webbing or straps to tear. The buckle is positively actuated to either lock or unlock the link, and does not depend on spring forces to hold the link securely coupled to the buckle. A double locking system is provided, whereby either lock-pin could fail and the link would remain securely coupled. Notwithstanding the highly secure locking aspects of the fastener, it can be readily deliberately and positively actuated by a simple squeezing action even if the crewman's hand may be heavily gloved or even injured.

While a certain illustrative buckle and link embodying the present invention have been shown in the drawings, and described above in considerable detail, it should be understood that there is no intention to limit the invention to the specific form disclosed. On the contrary, the intention is to cover all modifications, alternative constructions, equivalents and uses falling within the spirit and scope of the invention as expressed in the appended claims.

We claim as our invention:

1. A releasable fastener for securing together two straps, comprising the combination of a link adapted to be secured to one strap and defining opposed notches on opposite edges thereof, with a buckle adapted to be secured to the other strap and comprising a body having spaced-apart upper and lower plates defining a slot for receiving said link, a pair of spaced-apart rotatable lock-pins extending through said upper plate and said slot for releasable engagement with the notches defined in an inserted end of said link, a slide mounted on said upper plate for sliding movement thereon, means for biasing said slide to its forwardmost position, means operatively interconnecting said slide and said lock-pins for rotating said lock-pins in response to sliding movement of said slide thereby to position said lock-pins for locking or unlocking relationship with said link, a latch pivotally mounted on the buckle body for rotating movement in response to a force opposite in direction to the force required to move said slide to the link unlocking position, interfering surfaces on said slide and said latch for preventing movement of said slide when said slide is in its forwardmost position and said latch is in its latching position, and means biasing said latch normally to raise the interfering surface thereon upwardly away from the upper plate into interfering position with the slide, whereby the application of oppositely directed opposing forces on said latch and said slide releases said slide for movement rearwardly to rotate said lock-pins into link unlocking position, and the release of said forces allows said slide to move forwardly to rotate said lock-pins into locking position while simultaneously allowing said latch to swing back into interfering relationship with said slide.

2. The releasable fastener defined in claim 1 wherein said lock-pins are notched in the portion thereof exposed between said upper and lower plates to provide a land for engagement in the locking notches on said link, said lock-pin notches enabling said link to be inserted into said buckle when said slide is moved rearwardly to rotate the lock-pins to their unlock position.

3. The releasable fastener defined in claim 1 wherein said link includes a guide channel intermediate the link notches in one surface thereof, and said buckle includes means for cooperating with said link guide channel for guiding said link into engagement with said buckle.

4. A releasable fastener as defined in claim 1 wherein said link includes a plate-like strike portion having a locking lug on each opposed lateral edge thereof, said lugs defining said locking notches for receiving and engaging said buckle lock-pins.

5. A releasable fastener as defined in claim 1 wherein said slide is formed by a slide plate having depending side panels adapted to slidingly engage the upper body plate, and the body includes spaced upstanding flanges positioned for slidingly guiding said depending panels, and means rotatably mounting said latch between said flanges.

6. A releasable fastener as defined in claim 5 wherein said slide plate further includes a downwardly and rearwardly inclined front panel having a lower edge adapted for sliding engagement with the upper surface of the upper body plate, and an upstanding lip at the front edge of the slide plate, said upstanding lip having a front knurled surface.

7. A releasable fastener as defined in claim 5 wherein portions of the depending side panels are knurled to provide lateral gripping surfaces on said slide.

8. A releasable fastener as defined in claim 5 including a latch protector bar extending between said upstanding flanges rearwardly of said latch.

9. A releasable fastener as defined in claim 5 wherein the center of gravity of said latch is essentially on the axis of rotation thereof.

10. A releasable fastener for securing together two straps, comprising the combination of a plate-like link adapted to be secured to one strap and defining a strike having a pair of spaced-apart locking lugs on opposed lateral edges thereof forming locking notches therebehind, said strike having a guide channel in one surface thereof intermediate said lugs; with a buckle adapted to be secured to the other strap and comprising a body having spaced-apart upper and lower plates defining a slot for receiving said strike, guide means in said slot engageable with the guide channel in said strike for guiding said strike into said slot, a pair of spaced-apart lock-pins extending through said plates and said slot, the portion of said lock-pins exposed between the said plates being notched to define lands for engagement with said locking notches on said strike upon rotation of said lock-pins to position said lands in said notches, a slide mounted on said upper plate, a flanged slide post secured to said slide and slidably positioned in an elongated slot defined in said upper plate with said flange engaging the under surface of said upper plate to hold said slide thereon, a spring on said post having legs engaging the upper ends of said lock-pins for biasing said slide to its forwardmost position, a bifurcated lever secured to the upper end of each of the lock-pins, said levers having the forked ends thereof engaging said post for rotating said lock-pins in response to sliding movement of said slide thereby to position said lock-pins for locking or unlocking relationship with said strike, a latch pivotally mounted on the buckle body for rotating movement in response to a force thereon acting in a direction opposite to the force required to move said slide to the strike unlocking position, interfering surfaces on said slide and said latch for preventing movement of said slide, and means biasing said latch to raise the interfering surface thereon upwardly away from the upper plate into interfering position with the slide whereby the application of oppositely directed opposing forces on said latch and said slide rotates the latch to remove the interference and thus release said slide for movement rearwardly to rotate said lock-pins into strike unlocking position, and the release of said forces allows said slide to move forwardly to rotate said lock-pins into locking position while simultaneously allowing said latch to swing back into interfering relationship with said slide.

* * * * *